US009547325B2

(12) United States Patent
Vecera

(10) Patent No.: US 9,547,325 B2
(45) Date of Patent: Jan. 17, 2017

(54) LOW POWER BANDGAP CIRCUIT DEVICE WITH ZERO TEMPERATURE COEFFICIENT CURRENT GENERATION

(71) Applicant: INVENSENSE, INC., San Jose, CA (US)

(72) Inventor: Dusan Vecera, Stupava (SK)

(73) Assignee: INVENSENSE, INC., San Jose, CA (US)

( * ) Notice: Subject to any disclaimer, the term of this patent is extended or adjusted under 35 U.S.C. 154(b) by 13 days.

(21) Appl. No.: 14/625,227

(22) Filed: Feb. 18, 2015

(65) Prior Publication Data

US 2016/0239037 A1 Aug. 18, 2016

(51) Int. Cl.
*G05F 1/10* (2006.01)
*G05F 3/16* (2006.01)

(52) U.S. Cl.
CPC ..... *G05F 3/16* (2013.01)

(58) Field of Classification Search
CPC ..... G05F 3/30; G05F 3/267; G05F 1/468; H03K 17/223
USPC ..... 323/277, 311, 312, 313, 314, 315, 316,323/901, 907; 327/103, 512, 513, 535, 538, 327/539, 541, 561
See application file for complete search history.

(56) References Cited

U.S. PATENT DOCUMENTS 5,646,518 A 7/1997 Lakshmikumar et al.
5,666,046 A * 9/1997 Mietus ..... G05F 3/267 323/313
5,814,995 A * 9/1998 Tasdighi ..... G01R 19/16542 324/431
6,016,051 A 1/2000 Can
6,075,355 A * 6/2000 Filoramo ..... G05F 3/265 323/315
6,242,897 B1 6/2001 Savage et al.
6,529,066 B1 * 3/2003 Guenot ..... G05F 3/30 323/313
6,885,179 B1 4/2005 Ker et al.
6,906,581 B2 * 6/2005 Kang ..... G05F 3/30 323/313
6,972,703 B1 * 12/2005 Yen ..... G01R 19/16538 327/143
7,150,561 B1 12/2006 D'Aquino et al.
7,164,260 B2 * 1/2007 Neaves ..... G05F 3/30 323/316
7,750,726 B2 7/2010 Fujisawa et al.
7,787,642 B2 8/2010 Baker et al.
7,907,074 B2 * 3/2011 Zanchi ..... H03M 1/0863 323/268

(Continued)

OTHER PUBLICATIONS

Malcovati, et al. "Curvature-Compensated BiCMOS Bandgap with 1-V Supply Voltage", IEEE Journal of Solid-State Circuits, vol. 36, No. 7, Jul. 2001.

(Continued)

*Primary Examiner* — Rajnikant Patel
(74) *Attorney, Agent, or Firm* — Amin, Turocy & Watson, LLP

(57) ABSTRACT

A low power bandgap circuit device that generates temperature independent reference voltages and/or zero temperature coefficient currents is disclosed. The circuit comprises a first pair of transistors, an amplifier, a star connected resistive network, and a second pair of transistors, wherein zero temperature coefficient currents are generated through mirroring and reuse of current from the star connected resistive network.

29 Claims, 7 Drawing Sheets

(56) References Cited

U.S. PATENT DOCUMENTS

| | | | |
|---|---|---|---|
| 8,294,492 | B2 | 10/2012 | Bol et al. |
| 8,643,450 | B2 | 2/2014 | Mi et al. |
| 8,774,428 | B2 | 7/2014 | Jaar et al. |
| 8,786,271 | B2 | 7/2014 | Chang et al. |
| 2014/0015446 | A1 | 1/2014 | Peng et al. |

OTHER PUBLICATIONS

Bendali, et al. "A 1-V CMOS Current Reference With Temperature and Process Compensation", IEEE Transactions on Circuits and Systems—I: Regular Papers, vol. 54, No. 7, Jul. 2007.

Fayomi, et al., "Sub 1 V CMOS bandgap reference design techniques: a survey", Analog Integr Circ Sig Process, vol. 62, pp. 141-157, 2010.

Dai, et al., "Threshold voltage based CMOS voltage reference", IEE Proc-Circuites Devices Syst., vol. 151, No. 1, Feb. 2004.

* cited by examiner

LOW POWER BANDGAP CIRCUIT DEVICE WITH ZERO TEMPERATURE COEFFICIENT CURRENT GENERATION

TECHNICAL FIELD

This disclosure generally relates to embodiments for a low power bandgap circuit device for the generation of temperature independent reference voltages and/or zero temperature coefficient currents.

BACKGROUND

A bandgap reference circuit device is a temperature independent voltage reference circuit used in integrated circuits. Typically, bandgap reference circuit devices produce a fixed or constant voltage and are generally insensitive to power supply variations, temperature changes, and/or device loading. Consequently, as a result of these features, the bandgap reference circuit device is one of the most popular high performance voltage reference circuits employed in the integrated circuit industry today. Nevertheless, extant bandgap reference circuit devices have drawbacks, some of which will be noted with reference to the various embodiments described herein.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
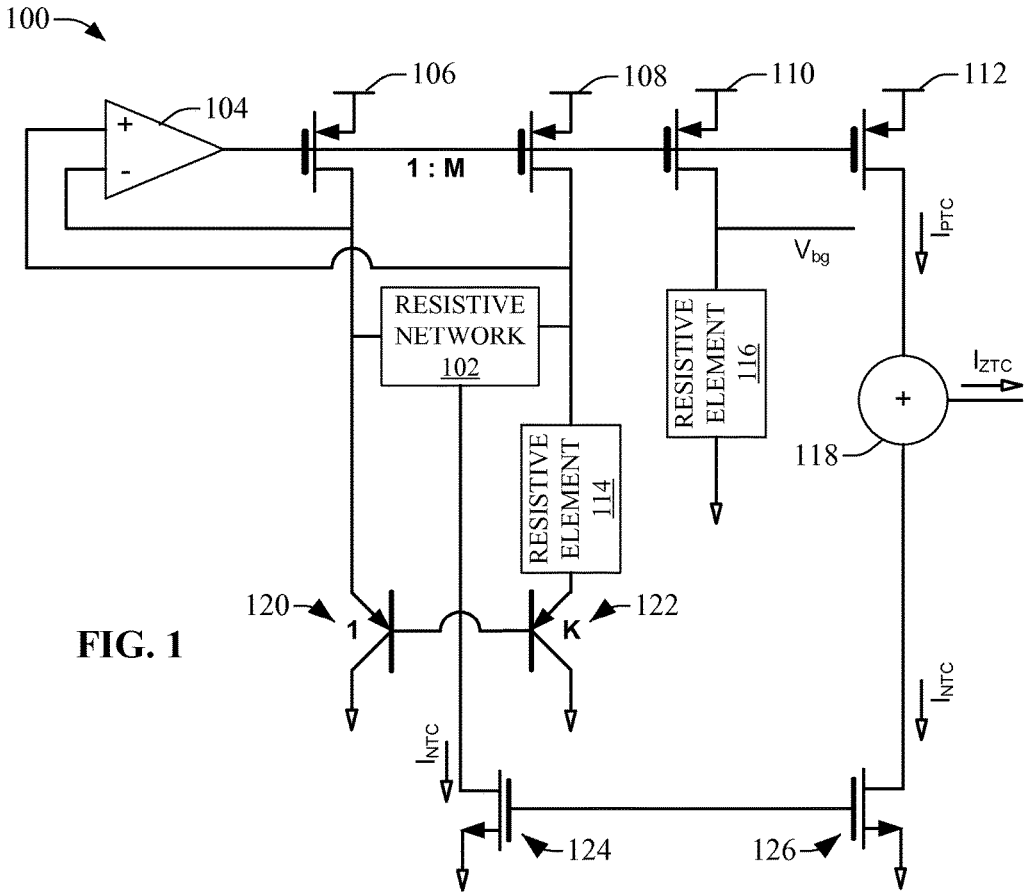
FIG. 1 illustrate a block diagram of a low power bandgap circuit device, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

In accordance with an embodiment, a low power bandgap circuit device that generates temperature independent reference voltages and zero temperature coefficient currents is disclosed and described. The low power bandgap circuit can comprise a first transistor device that can be coupled to a second transistor device, an amplifier device that can be coupled the first transistor device, a star connected resistive network that can also be coupled to the first transistor device and the second transistor device and a third transistor device and a fourth transistor device that can also be coupled, wherein a drain from the first transistor device can be coupled to the source of the third transistor device and a drain from the second transistor device can be coupled to the source of the fourth transistor device.

In accordance with the foregoing embodiment, the low power bandgap circuit device can further comprise a fifth transistor device that can be coupled to the second transistor device, wherein the drain of the fifth transistor device can generate temperature independent reference voltages. Additionally, the low power bandgap circuit device can also comprise a sixth transistor device that can be coupled to the fifth transistor device, wherein the drain of the sixth transistor device can supply positive temperature coefficient current to a summation circuit device.

Furthermore, the star connected resistor network of the low power bandgap circuit device can comprise a first resistive element that can be coupled to a second resistive element, the first resistive element also can be coupled to a third resistive element, and the second resistive element can further be coupled to the third resistive element, wherein the resistance value of the first resistive element can be determined as a function of a fractional value of a resistance value of a first reference resistive element divided by a value of a design parameter, wherein the value of the design parameter can be an integer value greater than one. Further, the resistance value of the second resistive element can be determined as a function of a fractional value of a resistance value of a second reference resistive element divided by the value of the design parameter. Additionally, the resistance value of the third resistive element can be determined as a function of a fractional value of the product of the first reference resistive element and the second reference resistive element divided by a value of the sum of the first reference resistive element and the second reference resistive element thereafter multiplied by a value one less than the value of the design parameter divided by the value of the design parameter.

Further, the star connected resistor network of the low power bandgap circuit device can be connected between a summing input of the amplifier device and a ground node. Further, the star connected resistor network can be coupled to a first metal oxide semiconductor device (e.g., n-channel metal oxide semiconductor device), wherein the first metal oxide semiconductor device can be coupled to a second metal oxide semiconductor device (e.g., n-channel metal oxide semiconductor device), and wherein a drain of the second metal oxide semiconductor device can be coupled to the output of a summation circuit device, and a drain of the second metal oxide semiconductor device can supply a negative temperature coefficient current. Moreover, the summation circuit device can combine a positive temperature coefficient current supplied from a drain of the sixth transistor device with a negative temperature coefficient current supplied from the second metal oxide semiconductor device to generate and supply a zero temperature coefficient current.

It should be noted with respect to the foregoing embodiment, the first transistor device, the second transistor device, the fifth transistor device, and the sixth transistor device can be positive metal oxide semiconductor devices (e.g., p-channel metal oxide semiconductor devices). Further, with regard to the third transistor device and the fourth transistor device, these can be bipolar transistor devices or semiconductor diode devices or metal oxide semiconductor devices. Moreover, in relation to the first metal oxide semiconductor device and the second metal oxide semiconductor device, these can be negative metal oxide semiconductor transistor devices, or n-channel metal oxide semiconductor devices.

In accordance with further embodiments, a low power bandgap reference circuit device is disclosed. The low power bandgap reference circuit device can comprise a first resistive element coupled to a second resistive element and a third resistive element, the first resistive element, the second resistive element, and the third resistive element can be configured to form a star resistor network, wherein a first resistance associated with the first resistive element can be determined as a function of a first reference resistive element, the second resistance associated with the second resistive element can be determined as a function of a second reference resistive element, and a third resistance associated with the third resistive element can be determined as a function of the first reference resistive element and the second reference resistive element.

The star resistor network formed by the first resistive element coupled to the second resistive element and further coupled to the third resistive element can be connected between a summing input of an amplifier (e.g., a loop amplifier) and a ground node. The resistance value of the first resistive element can be determined as the fractional value of the first reference resistive element denominated by a value of a defined design parameter, wherein the value of the defined design parameter has a value greater than one; the resistance value of the second resistive element can be determined as the fractional value of the second reference resistive element denominated by the value of the design parameter; and the resistive value of the third resistive element can be determined as the fractional value of a product of the resistive value of the first reference resistive element and the resistive value of the second reference resistive element denominated by a sum of the resistive value of the first reference resistive element and the resistive value of the second reference resistive element multiplied by a value of one less than the value of the defined design parameter denominated by the value of the defined design parameter.

The third resistive element included in the star resistor network can comprise a first sub resistive element and a second sub resistive element, wherein the first sub resistive element and the second sub resistive element can, for example, be coupled in series. Moreover, the star resistor network can also be coupled to a fourth resistive element, wherein a flow of negative temperature coefficient current flows through the fourth resistive element. The fourth resistive element can be a first metal oxide semiconductor device, wherein the star resistor network can be coupled to the drain of the first metal oxide semiconductor device, and the gate of the first metal oxide semiconductor device can be coupled to a defined location between the first sub resistive element and the second sub resistive element that can comprise the third resistive element. Additionally, the gate of the first metal oxide semiconductor device can be coupled to a gate of a second metal oxide semiconductor device, wherein the drain of the second metal oxide semiconductor device can be coupled to a current summation circuit device, wherein a zero temperature coefficient current can be generated.

The described low power bandgap reference circuit device can further comprise a positive metal oxide semiconductor device the drain of which can be coupled to the current summation circuit device, wherein the drain of the positive metal oxide semiconductor device can supply positive temperature coefficient current to the current summation circuit device, and the drain of the second metal oxide semiconductor device can supply current with a negative temperature coefficient.

The foregoing disclosed and described low power bandgap reference circuit device can generate a temperature independent voltage by a flow of current through a first bipolar transistor device and a second bipolar transistor device, wherein the first bipolar transistor device and the second bipolar transistor device can be coupled to the star resistor network.

Reference throughout this specification to "one embodiment," or "an embodiment," implies that a particular feature, structure, or characteristic described in connection with the embodiment is included in at least one embodiment. Thus, appearance of the phrase "in one embodiment," or "in an embodiment," in various places throughout this specification are not necessarily all referring to the same embodiment. Furthermore, the particular features, structures, or characteristics may be combined in any suitable manner in one or more embodiments.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Furthermore, the word "exemplary", "example", and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art of sound based navigation technologies.

Turning now to the figures, FIG. 1 illustrates a low power bandgap reference circuit device 100 that can generate temperature independent reference voltages and zero temperature coefficient current. Low power bandgap reference circuit device 100 can comprise a resistive network 102, wherein the resistive elements (e.g., typically a group of one or more resistors) included in resistive network 102 can be configured and/or fabricated to form a star formation/configuration. Further, coupled to the resistive network 102 can be an amplifier 104, which in turn, and as illustrated, can be coupled to first transistor device 106. First transistor device 106, through an associated gate, can be coupled to second transistor device 108. As will be observed from examination of FIG. 1, the ratio of device area (e.g., 1:M) occupied by second transistor device 108 can be an larger than the die space occupied by first transistor device 106. Thus, second transistor device 108 can be of an order M larger than first transistor device 106, wherein M can generally be a real number smaller than or greater than or equal to 1, though typically, M can be a positive integer greater than or equal to one. Further, first transistor device 106, through a drain aspect associated with first transistor device 106, can also be coupled to a first bipolar transistor device 120.

Second transistor device 108, as illustrated, through an associated gate aspect, can be coupled to a third transistor device 110, wherein a drain aspect of the third transistor device 110 can be coupled to resistive element 116. A temperature independent output voltage $V_{bg}$ can be generated through a flow of current ($I_{PTC}$) flowing through resistive element 116. Additionally, as also depicted, third transistor device 110, through an associated gate aspect, can be coupled to a fourth transistor device 112, wherein a positive temperature coefficient current ($I_{PTC}$) can flow through fourth transistor device 112 to a summation circuit device 118. The summation circuit device 118 can combine a negative temperature coefficient current ($I_{NTC}$) flowing through transistor device 126 with the positive temperature coefficient current ($I_{PTC}$) through the fourth transistor device 112 to generate or supply a zero temperature coefficient current ($I_{ZTC}$).

Second transistor device 108, as also illustrated in FIG. 1, can additionally be coupled, via a drain aspect associated with the second transistor device 108, to resistive element 114. It will be noted in the context of resistive network 102 that this component can be coupled between a drain associated with first transistor device 106 and the drain associated with second transistor device 108. Moreover, it will also be observed that the coupling of resistive network 102 in relation to second transistor device 108 generally precedes the coupling of second transistor device 108 to the resistive element 114, and that the coupling of the first transistor device 108 and the resistive network 102 typically precedes the coupling of the first transistor device 108 to the first bipolar transistor device 120. Additionally, it will be noted that the drain of the first transistor device 106 can be coupled to a negative terminal of the amplifier device 104 and the drain of the second transistor device 108 can be coupled to a positive terminal associated with the amplifier device 104.

In relation to resistive element 114 that can have been coupled to a drain associated with the second transistor device 108, resistive element 114 can also be coupled to a second bipolar transistor device 122. Further, as will be observed from examination of FIG. 1, transistor device 124 can be coupled to resistive network 102 and to transistor device 126, wherein a negative temperature coefficient current ($I_{NTC}$) can flow through transistor device 124 as well as transistor device 126. It will also be noted in connection with first bipolar transistor device 120 and second bipolar transistor device 122, that the die areas occupied by these respective device can be in accordance with a ratio 1:K, wherein K can be a real number greater than or equal to one, though typically K will be an integer value greater than or equal to one.

Figure 2:
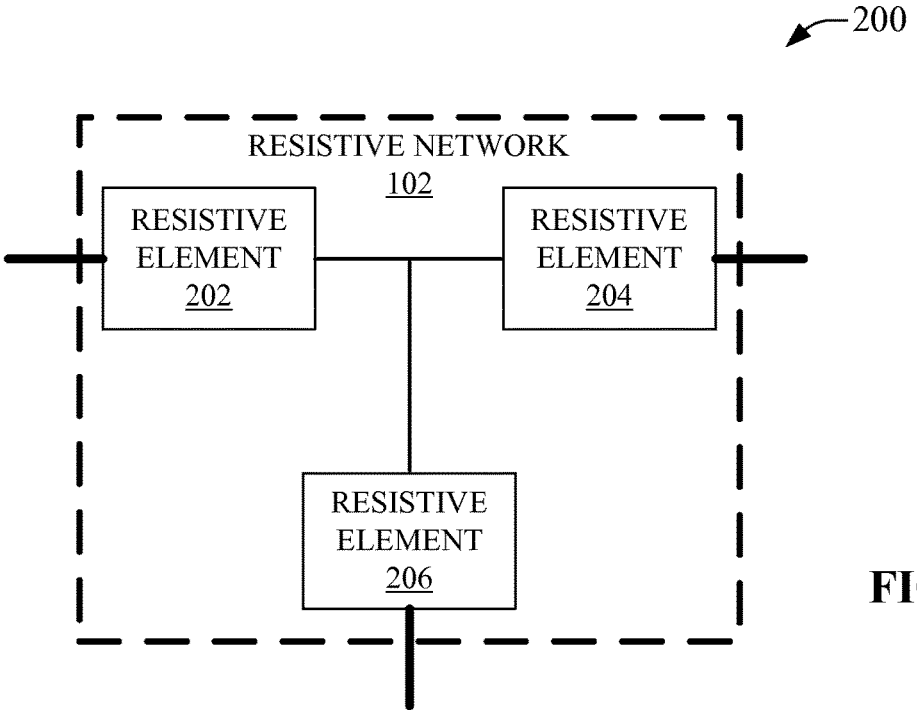
FIG. 2 illustrates a block diagram of a resistive network, in accordance with various embodiments.

FIG. 2 provides further illustration 200 of resistive network 102 in accordance with a non-limiting embodiment. As depicted resistive network 102 can comprise a first resistive element 202 coupled to a second restive element 204. Further the first resistive element 202 can also be coupled to a third resistive element 206, wherein the coupled first resistive element 202, second resistive element 204, and third resistive element 206 can be shaped to form or fabricate a star configuration. The resistance value associated with the first resistive element 202 can be determined as a function of, or based on, a first reference resistive element. Similarly, the resistance value associated with the second resistive element 204 can be determined as a function of, or based on, a second reference resistive element, and the resistance value associated with the third resistive element 206 can be determined based on, or as a function of, resistance values associated with the first reference resistive element and the second resistive element and a value of a defined or definable design parameter.

Figure 7:
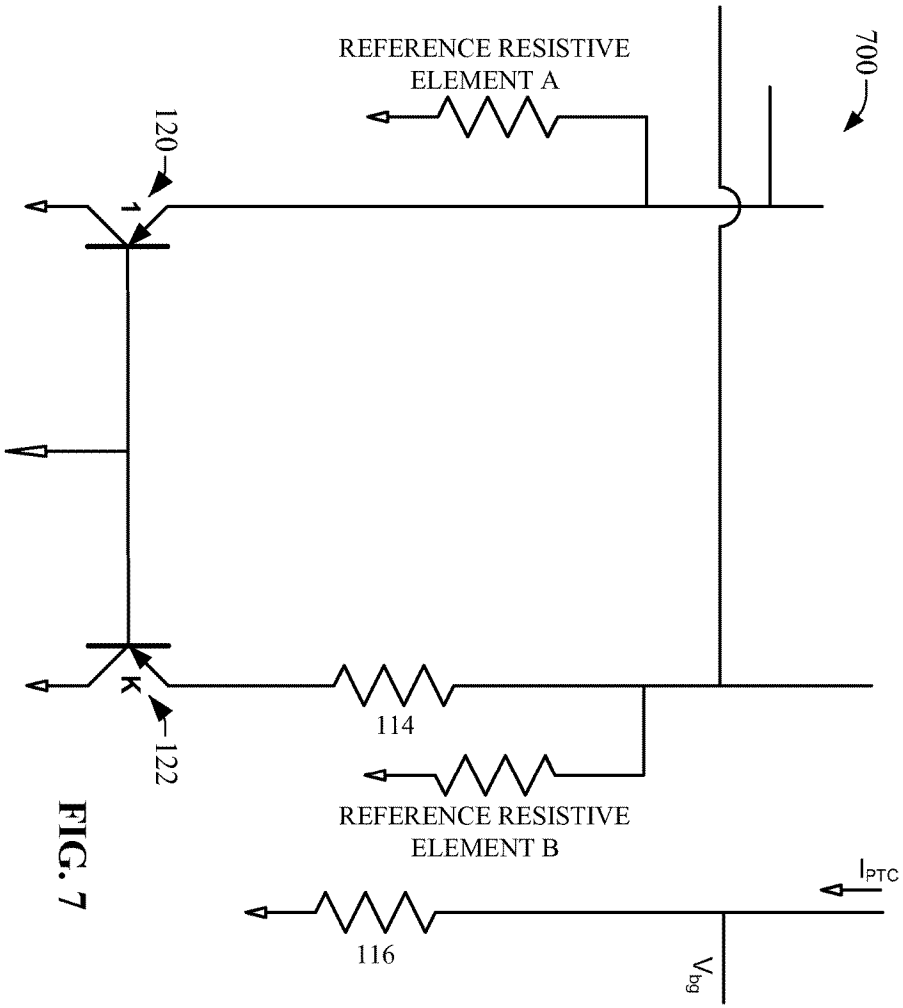
FIG. 7 illustrates a block diagram of a low power bandgap circuit device, in accordance with various embodiments.

As an aside and as illustrated in FIG. 7, low power bandgap reference circuit devices have to date been constructed using two resistive elements, wherein the first resistive element (e.g., reference resistive element A) can be connected both to a drain of the first transistor device (e.g., transistor device 106) as well as to an emitter of a first bipolar transistor device (e.g., bipolar transistor device 120), and wherein the second resistive element (e.g., reference resistive element B) can be coupled to a drain of the second transistor device (e.g., transistor device 108). Moreover, as described in relation to FIG. 1, the second transistor device 108, as illustrated in FIG. 7, can be coupled to resistive element 114 which in turn can be coupled to a emitter associated with a second bipolar transistor device (e.g., bipolar transistor device 122). Further, as also described in connection with FIG. 1, resistive element 116, as depicted in FIG. 7, can be coupled to a gate associated with a third transistor device (e.g., transistor device 110), wherein a positive temperature coefficient current ($I_{PTC}$) can flow through resistive element 116 to generate a temperature independent output voltage ($V_{bg}$).

Returning now to description of FIG. 2, and in particular on the determination of the resistance value to be associated with the first resistive element 202. This resistance value can be determined as a function of a resistance value associated with a first reference resistive element (e.g., reference resistive element A as illustrated in FIG. 7) and a defined or definable design parameter value (N). For instance, in accordance with a non-limiting embodiment, the resistance value associated with the first reference resistive element can be divided by the value of the defined or definable design parameter (N). Thus, the resistance value associated with the first resistive element 202 can be expressed as $R_{202}=R_A/N$, wherein, $R_{202}$ denotes the resistance value associated with the first resistive element 202, $R_A$ represents a resistance value associated with the first reference resistive element, and N is a value associated with the defined or definable design parameter. In the context of the defined or definable design parameter, this value can be a real number greater than one, though for most practical purposes the value of N will most typically be expressed as an integer with a value greater than one.

In the context of determining the resistance value to be associated with the second resistive element 204, this value can be determined as a function of a resistance value associated with a second reference resistive element (e.g., reference resistive element B, as depicted in FIG. 7) and the defined or definable design parameter value (N). For example, and in accordance with a non-limiting embodiment, the value of the resistance associated with the second resistive element 204 can be determined by dividing the resistance value associated with the second reference resistive element by the value of the defined or definable design parameter. The resistance value of the second resistive element 204 can therefore be expressed as: $R_{204}=R_B/N$, wherein $R_{204}$ represents the resistance value to be associated with the second resistive element 204, $R_B$ can be representative of the resistance value associated with the second reference resistive element, and as above, N can represent the value of the defined or definable design parameter.

With regard to determining the resistance value to be associated with the third resistive element 206, this can be determined by dividing the product of resistance value of the first reference resistive element and resistance value of the second reference resistive element by the sum of the resistance values of the first reference resistive element and the second reference resistive element, and thereafter multiplying the result by a fractional value of the defined or definable design parameter (N) represented as:

$$\frac{N-1}{N}.$$

The resistance value of the third resistive element 206 can therefore be expressed as:

$$R_{206} = \frac{N-1}{N} \cdot \frac{R_A R_B}{R_A + R_B},$$

where $R_{206}$ represents the resistance value to be associated with the third resistive element 206, $R_A$ represents the resistance value associated with the first reference resistive element, $R_B$ is representative of the resistance value associated with the second reference resistive element, and N represents the value of the defined or definable design parameter.

Figure 3:
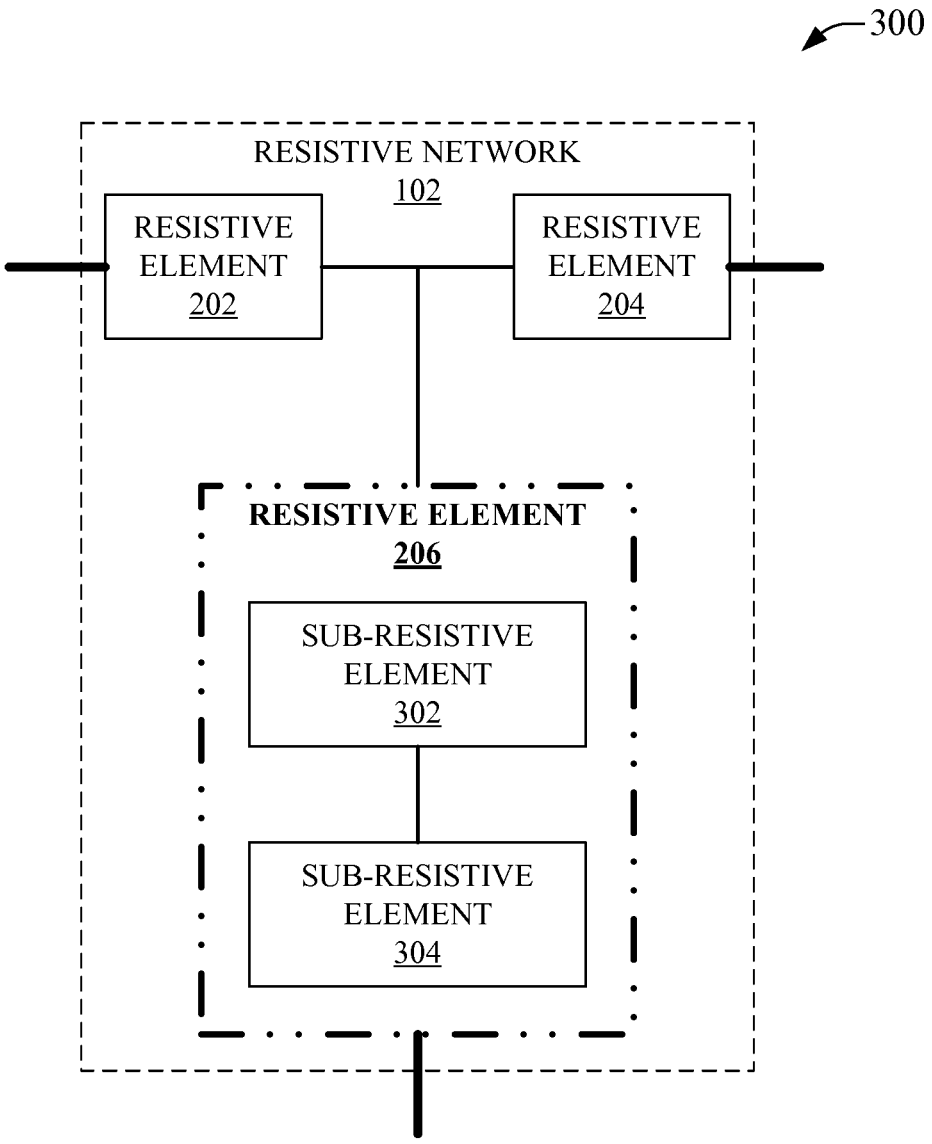
FIG. 3 illustrates a block diagram of a resistive network, in accordance with various embodiments.

FIG. 3 provides further illustration 300 of resistive network 102, and in particular further depiction of resistive element 206. In this non-limiting embodiment, resistive element 206 can be divided into at least two distinct sub resistive elements, wherein the value of the combined resistance of the first sub resistive element 302 and the second sub resistive element 304 can be determined as outlined above for the third resistive element 206. More particularly, the sum of resistance values of sub-resistive element 302 and sub-resistive element 304 should equate to the determined resistance value of the third resistive element 206, e.g., $$R_{206} = \frac{N-1}{N} \cdot \frac{R_A R_B}{R_A + R_B}.$$

By adjusting the ratio of sub-resistive element 302 and sub-resistive element 304 the common mode voltage on the input of the amplifier 104 can be adjusted, which can simplify design of the amplifier 104 and can result in a reduction of power.

Figure 4:
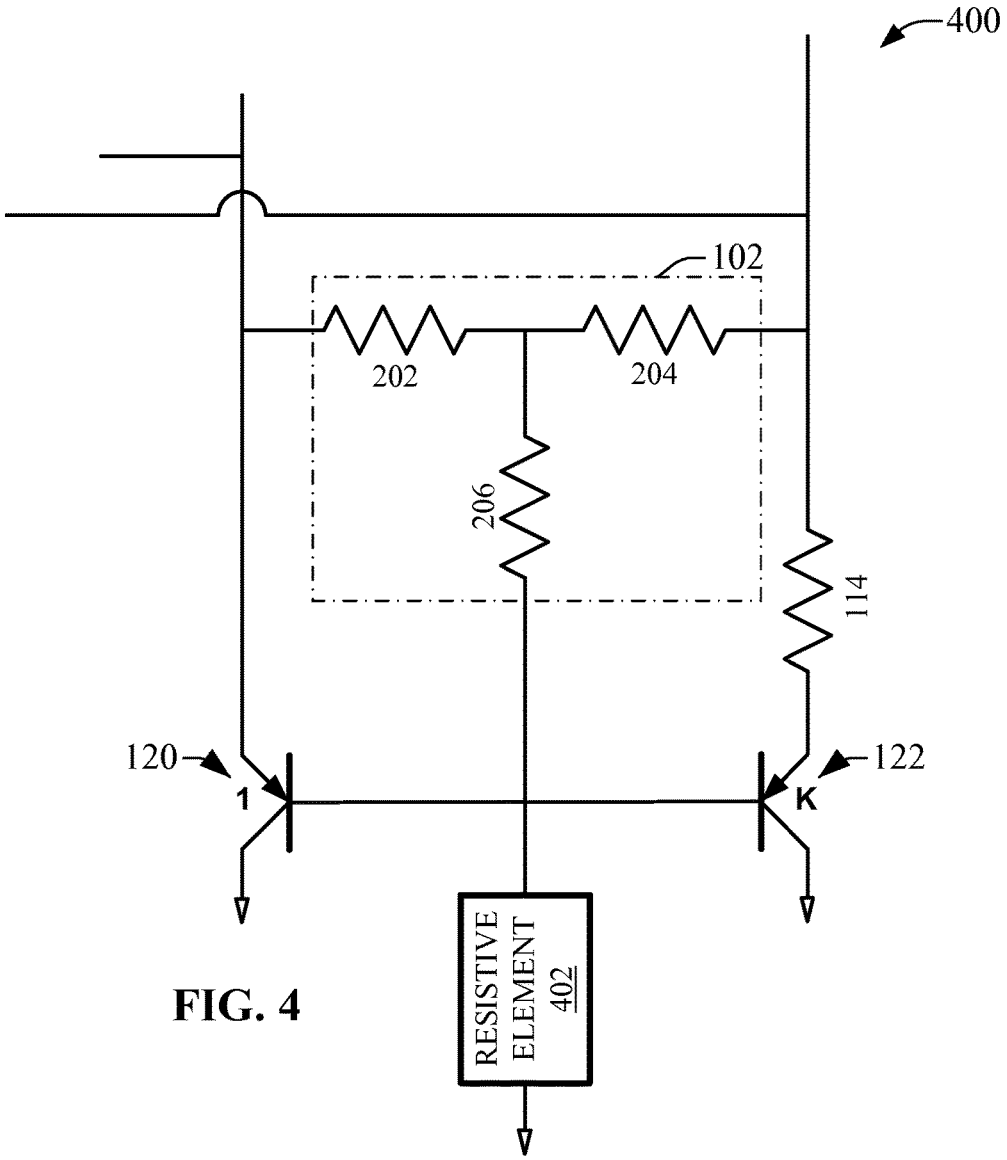
FIG. 4 illustrates a block diagram of another low power bandgap circuit device including an additional resistive element, in accordance with various embodiments.

FIG. 4 provides partial illustration of a low power bandgap reference circuit device 400 in accordance with a non-limiting embodiment. As illustrated, the resistive network 102, comprising resistive element 202, resistive element 204, and resistive element 206 can be formed or shaped into a star formation that can be coupled to resistive element 402, such as a resistor or diode or a metal oxide semiconductor transistor device. By adjusting the value of resistive element 402 the common mode voltage at the input of the amplifier 104 can be adjusted, which simplifies design of amplifier 104 and results in further reduction in power.

Figure 5:
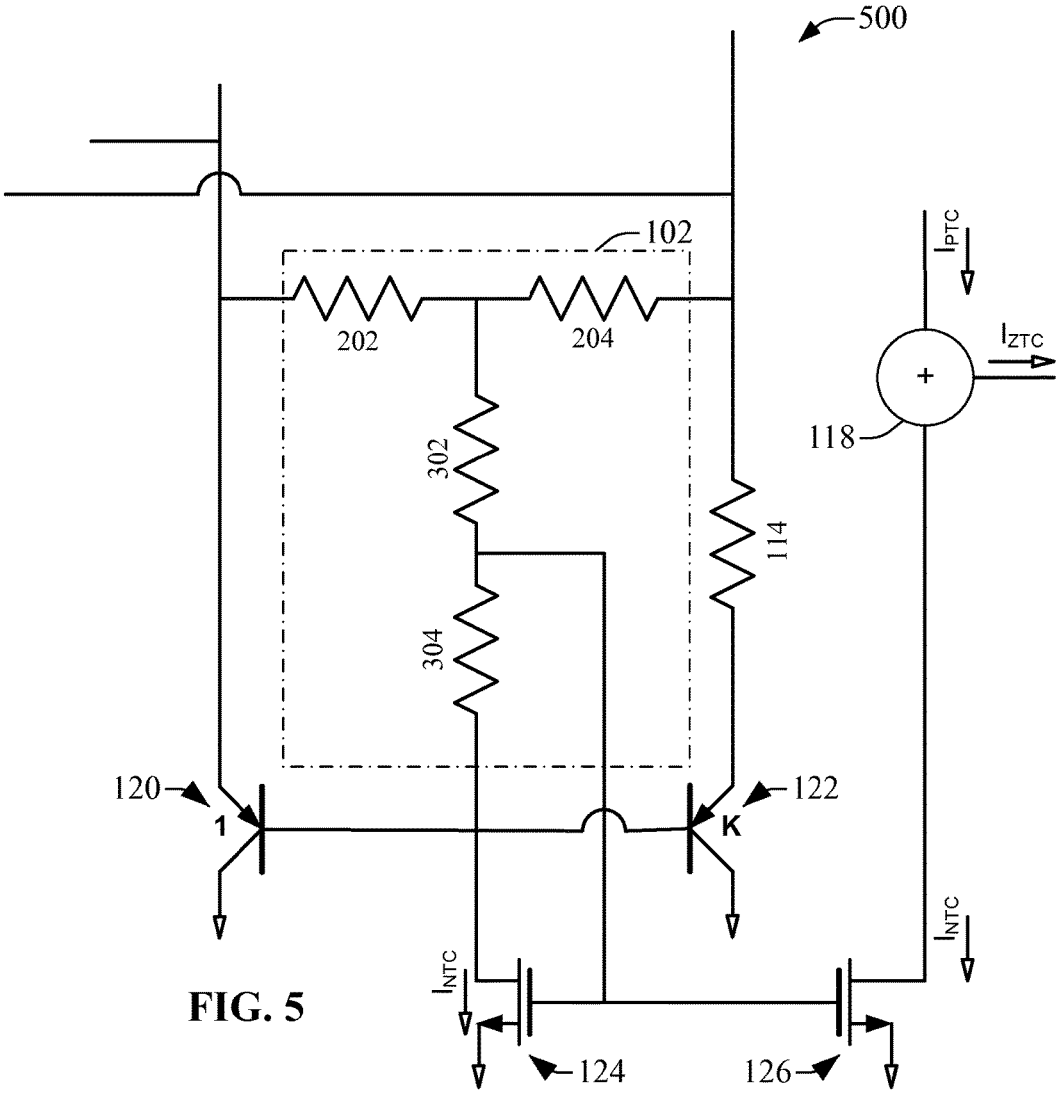
FIG. 5 illustrates a block diagram of further a low power bandgap circuit device including coupled n-channel metal oxide semiconductor devices, in accordance with various embodiments.
Figure 6:
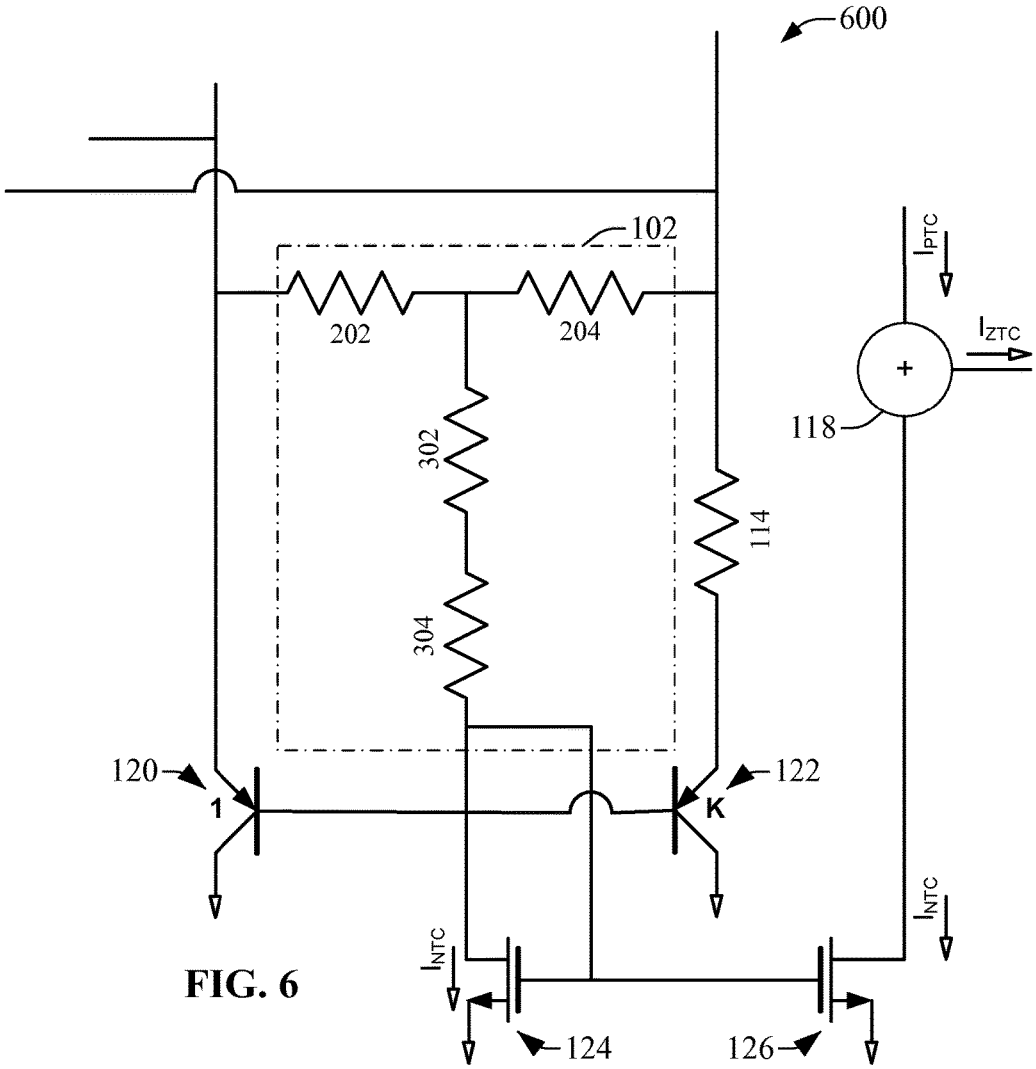
FIG. 6 illustrates block diagram of an additional a low power bandgap circuit device including coupled n-channel metal oxide semiconductor devices, in accordance with various embodiments.

FIG. 5 provide a further partial illustration of a low power bandgap reference circuit device 500 in accordance with a non-limiting embodiment. As illustrated, resistive network 102, comprising resistive element 202, resistive element 204, and sub-resistive elements 302 and 304, that as detailed above can be utilized to provide the resistance necessary to form the third resistive element 206. It will be observed that, in this instance, the resistive network 102 can be connected to a drain of the transistor device 124 (e.g., an n-channel metal oxide semiconductor device). Further, the drain of transistor device 124 can be connected to a common node of the resistive network 102 (comprising resistive element 202, resistive element 204, and resistive element 206), as illustrated in FIG. 6. Moreover, as illustrated in FIG. 5, the connection between the drain of transistor device 124 and the resistive network 102 can be between the two resistive elements (e.g., sub-resistive element 302 and sub-resistive element 304). Thus, by adjusting the ration of sub-resistive element 302 and sub-resistive element 304, the common mode voltage on the input of amplifier 104 can be adjusted, which can simplify design of amplifier 104 which in turn can result in further reduction in power. Moreover, the current flowing through resistive element 124 can be determined by a ratio of base-emitter voltage $V_{BE}$ and a combination of star connected resistors (e.g., resistive element 202, resistive element 204, and resistive element 206 (or sub-resistive element 302 and sub-resistive element 304)). Moreover, since the base-emitter voltage $V_{BE}$ typically has a strong negative temperature coefficient (NTC) the current flowing through transistor device 124 can also have a negative temperature coefficient and can be easily mirrored and reused in another part of the circuit device.

FIG. 6 provides an addition illustration of a lower bandgap reference circuit device 600 in accordance with a further non-limiting embodiment. As illustrated, current with negative temperature coefficient ($I_{NTC}$) can be derived by mirroring the current from the resistive network 102 (e.g., resistive element 202, resistive element 204, and resistive element 206 (or sub-resistive element 302 and sub-resistive element 304)) by means of transistor device 124 and transistor device 126. The negative temperature coefficient current from transistor device 126 can then be combined with a positive temperature current ($I_{PTC}$) at a summation circuit device 118 to provide current with a zero temperature coefficient ($I_{ZTC}$).

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A low power bandgap reference circuit, comprising:

a first resistive element coupled to a second resistive element and a third resistive element, the first resistive element, the second resistive element, and the third resistive element configured to form a star resistor network, wherein a first resistance associated with the first resistive element is determined as a function of a first reference resistive element, a second resistance associated with the second resistive element is determined as a function of a second reference resistive element, and a third resistance associated with the third resistive element is determined as a function of the first reference resistive element and the second reference resistive element.

2. The low power bandgap reference circuit of claim 1, wherein the star resistor network is connected between a summing input of an amplifier and a ground node.

3. The low power bandgap reference circuit of claim 1, wherein a temperature independent voltage is generated by a flow of current through a first bipolar transistor and a second bipolar transistor.

4. The low power bandgap reference circuit of claim 1, wherein a value of the first resistive element is determined as a fraction of a resistive value of the first reference resistive element denominated by a value of a defined design parameter, wherein the value of the defined design parameter has a value greater than one.

5. The low power bandgap reference circuit of claim 4, wherein a value of the second resistive element is determined as a fraction of a resistive value of the second reference resistive element denominated by the value of the defined design parameter.

6. The low power bandgap reference circuit of claim 4, wherein a value of the third resistive element is determined as a fraction of a product of the resistive value of the first reference resistive element and the resistive value of the second reference resistive element denominated by a sum of the value of the first reference resistive element and the value of the second reference resistive element multiplied by a value of one less than the value of the defined design parameter denominated by the value of the defined design parameter.

7. The low power bandgap reference circuit of claim 1, wherein the third resistive element comprises a first sub resistive element and a second sub resistive element, wherein the first sub resistive element and the second sub resistive element are coupled in series.

8. The low power bandgap reference circuit of claim 7, wherein the star resistor network is coupled to a fourth element.

9. The low power bandgap reference circuit of claim 8, wherein the fourth resistive element is a first n-channel metal oxide semiconductor device.

10. The low power bandgap reference circuit of claim 9, wherein a gate of the first n-channel metal oxide semiconductor device is coupled to a source of the first n-channel metal oxide semiconductor device.

11. The low power bandgap reference circuit of claim 9, wherein a gate of the first n-channel oxide semiconductor device is coupled to a defined location between the first sub resistive element and the second sub resistive element of the third resistive element.

12. The low power bandgap reference circuit of claim 10, wherein a gate of the first n-channel metal oxide semiconductor device is coupled to a gate of a second n-channel metal oxide semiconductor device.

13. The low power bandgap reference circuit of claim 11, wherein a gate of the first n-channel metal oxide semiconductor device is coupled to a gate of a second n-channel oxide semiconductor device.

14. The low power bandgap reference circuit of claim 13, wherein a drain of the second n-channel metal oxide semiconductor device is coupled to a current summation circuit, wherein a zero temperature coefficient current is generated.

15. The low power bandgap reference circuit of claim 14, wherein a drain of a p-channel metal oxide semiconductor device is coupled to the current summation circuit.

16. The low power bandgap reference circuit of claim 15, wherein the drain of the p-channel metal oxide semiconductor device supplied positive temperature coefficient current to the current summation circuit.

17. The low power bandgap reference circuit of claim 12, wherein a drain of the second n-channel metal oxide semiconductor device supplies current with a negative temperature coefficient.

18. The low power bandgap reference circuit of claim 8, wherein a flow of negative temperature coefficient current flows through the fourth element.

19. A low power bandgap circuit device for providing a temperature independent reference voltage and a zero temperature coefficient current, comprising:

a first bipolar transistor device coupled to a second bipolar transistor device;

a loop amplifier device coupled to the first bipolar transistor device;

a star connected resistor network coupled in parallel to the first bipolar transistor device and the second bipolar transistor device, wherein the star connected resistor network comprises a first resistive element coupled to a second resistive element, the first resistive element coupled to a third resistive element, and the second resistive element coupled to the third resistive element, and wherein a first resistance value associated with the first resistive element is determined based on a first reference resistive element, a second resistance value associated with the second resistive element is determined based on a second reference resistive element, and a third resistance value associated with the third resistive element is determined based on first reference resistive element and the second reference resistive element; and a first p-channel metal oxide semiconductor transistor device and a second p-channel metal oxide semiconductor transistor device coupled in series, wherein an emitter of the first bipolar transistor device is coupled to the first p-channel metal oxide semiconductor transistor device and an emitter of the second bipolar transistor device is coupled to an emitter of the second bipolar transistor device through a resistor.

20. The low power bandgap circuit device of claim 19, further comprising a third p-channel metal oxide semiconductor transistor device coupled in series to the second p-channel metal oxide semiconductor transistor device, wherein the drain of the third p-channel metal oxide semiconductor transistor device generates the temperature independent reference voltage.

21. The low power bandgap circuit device of claim 20, further comprising a fourth p-channel metal oxide semiconductor transistor device coupled in series to the third p-channel metal oxide semiconductor transistor device, wherein a drain of the forth p-channel metal oxide semiconductor transistor device supplies positive temperature coefficient current to a summation circuit device.

22. The low power bandgap circuit device of claim 19, wherein the resistance value associated with the first resistive element is determined as a function of a fractional value of a resistance value associated with the first reference resistive element divided by a value of a design parameter, wherein the value of the design parameter is value greater than one.

23. The low power bandgap circuit device of claim 19, wherein the second resistance value associated with the second resistive element is determined as function of a fractional value of a resistance value associated with the second reference resistive element divided by the value of the design parameter.

24. The low power bandgap circuit device of claim 22, wherein the third resistance value associated with the third resistive element is determined as a function of a fractional value of a product of the first reference resistive element and the second reference resistive element divided by a value of a sum of the first reference resistive element and the second reference resistive element multiplied by a value one less than the value of the design parameter divided by the value of the design parameter.

25. The low power bandgap circuit device of claim 19, wherein the star resistor network is connected to a summing input of the amplifier device.

26. The low power bandgap circuit device of claim 19, wherein the star resistor network is coupled to a first n-channel metal oxide semiconductor device.

27. The low power bandgap circuit device of claim 25, wherein the first n-channel metal oxide semiconductor device is coupled to a second n-channel metal oxide semiconductor device.

28. The low power bandgap circuit device of claim 26, wherein a drain of the second n-channel metal oxide semiconductor device is coupled to a summation circuit device and a drain of the second n-channel metal oxide semiconductor device outputs a negative temperature coefficient current.

29. The low power bandgap circuit device of claim 28, wherein the summation circuit device combines a positive temperature coefficient current supplied from a drain of a fourth transistor device with the negative temperature coefficient current to generate the zero temperature coefficient current.

* * * * *